US008314675B2

(12) United States Patent
Zillmann et al.

(10) Patent No.: US 8,314,675 B2
(45) Date of Patent: Nov. 20, 2012

(54) METHOD FOR PRODUCTION OF A WINDING BLOCK FOR A COIL OF A TRANSFORMER AND WINDING BLOCK PRODUCED IN THIS WAY

(75) Inventors: Karl-Heinz Zillmann, Marsberg (DE); Rudolf Schutzeichel, Ense (DE); Christian Gruettner, Ruethen (DE); Benjamin Weber, Winterberg (DE)

(73) Assignee: ABB Technology AG, Zürich (CH)

( * ) Notice: Subject to any disclaimer, the term of this patent is extended or adjusted under 35 U.S.C. 154(b) by 19 days.

(21) Appl. No.: 12/851,224

(22) Filed: Aug. 5, 2010

(65) Prior Publication Data

US 2011/0032064 A1 Feb. 10, 2011

Related U.S. Application Data

(63) Continuation of application No. PCT/EP2009/000495, filed on Jan. 27, 2009.

(30) Foreign Application Priority Data

Feb. 7, 2008 (DE) ..... 10 2008 007 676

(51) Int. Cl.
*H01F 27/30* (2006.01)
*H01F 27/28* (2006.01)
*H01F 7/06* (2006.01)

(52) U.S. Cl. ..... 336/196; 336/222; 336/199; 29/605

(58) Field of Classification Search ..... 336/196, 336/198, 199, 205–209, 222; 29/605
See application file for complete search history.

(56) References Cited

U.S. PATENT DOCUMENTS 1,036,935 A * 8/1912 Underhill ..... 336/206
1,036,937 A * 8/1912 Underhill ..... 242/444.4
1,864,331 A * 6/1932 Whitesmith ..... 336/205
(Continued)

FOREIGN PATENT DOCUMENTS

DE 2157452 A1 11/1972
(Continued)

OTHER PUBLICATIONS

International Search Report (PCT/ISA/210) issued on May 25, 2009, by European Patent Office as the International Searching Authority for International Application No. PCT/EP2009/000495.

(Continued)

*Primary Examiner* — Mohamad Musleh
*Assistant Examiner* — Mangtin Lian
(74) *Attorney, Agent, or Firm* — Buchanan Ingersoll & Rooney PC

(57) ABSTRACT

A method is disclosed for production of a winding block for a coil of a transformer, having at least one winding composed of electrically conductive wire or strip material with a plurality of turns. An insulating layer is composed of electrically insulating fiber material with a specific number of windings of the insulating fiber material. The turns composed of electrical conductive material are fitted independently of the turns of the insulating material and, after a predetermined number of turns of electrically conductive material have been fitted, a smaller number of turns of electrically insulating material are fitted over the same section onto these turns of electrically conductive material, such that electrically insulating material which remains before reaching a number of turns of electrically conductive material is used as edge insulation.

4 Claims, 1 Drawing Sheet

U.S. PATENT DOCUMENTS

| | | | | |
|---|---|---|---|---|
| 2,656,290 | A * | 10/1953 | Berberich et al. | 156/185 |
| 4,733,213 | A * | 3/1988 | Graul | 336/206 |
| 2008/0223517 | A1 | 9/2008 | Kaltenborn et al. | |

FOREIGN PATENT DOCUMENTS

| | | | |
|---|---|---|---|
| DE | 4445423 | A1 | 6/1996 |
| EP | 0825624 | A2 | 2/1998 |
| FR | 2637729 | A1 | 4/1990 |
| JP | 58-201320 | A | 11/1983 |
| JP | 60-89909 | A | 5/1985 |
| WO | WO 2007/033499 | A1 | 3/2007 |

OTHER PUBLICATIONS

German Search Report issued Jul. 1, 2009 by the German Patent Office for German Application No. 102008007676.7.

* cited by examiner

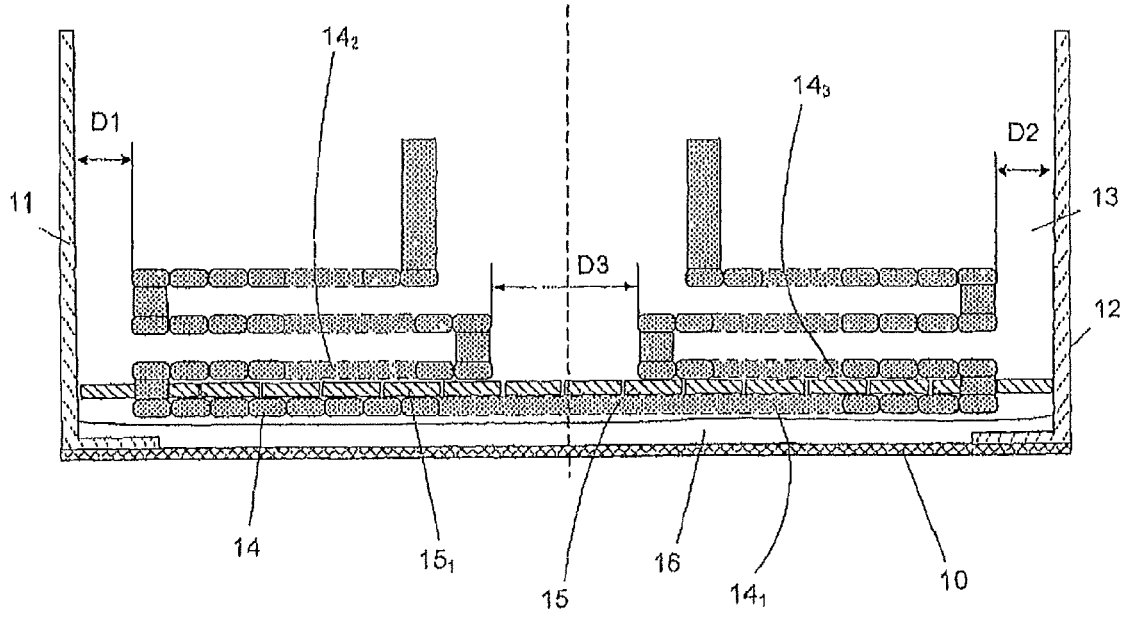
$14_2$
$14_3$
D1
D2
11
13
D3
12
14
$15_1$
15
16
$14_1$
10

METHOD FOR PRODUCTION OF A WINDING BLOCK FOR A COIL OF A TRANSFORMER AND WINDING BLOCK PRODUCED IN THIS WAY

RELATED APPLICATIONS

This application claims priority as a continuation application under 35 U.S.C. §120 to PCT/EP2009/000495, which was filed as an International Application on Jan. 27, 2009, designating the U.S., and which claims priority to German Patent Application 10 2008 007 676.7 filed in Germany on Feb. 7, 2008. The entire contents of these applications are hereby incorporated by reference in their entireties.

FIELD

The disclosure relates to a method for producing a coil of a transformer, and to a winding block for a coil of a transformer.

BACKGROUND INFORMATION

DE 44 45 423.6-09 discloses a method for production of a winding block of a dry transformer, in which the individual layers of electrically conductive wire or ribbon material are insulated from one another by an insulation layer composed of resin-impregnated fiber material. In this case, for example before the high-voltage winding is applied, the maximum insulation thickness specified for the layer insulation and the number of fiber rovings corresponding to this insulation thickness are determined; each winding layer and the associated insulation layer are produced at the same time, but with a physical offset with respect to one another, with the insulation thickness being set both by the number of fiber rovings and by the winding feed of the fiber rovings.

In addition to the layer insulation between the turns of electrical wire or ribbon material, the entire insulation of a winding is composed of edge insulation, which can be introduced at the end of the winding. Since, for simultaneous winding of conductor material and insulation material, the same number of turns are available, the insulation at the end of the actual winding process is introduced subsequently, involving an increased amount of work.

SUMMARY

A method for production of a winding block for a coil of a transformer is disclosed, comprising: applying plural turns of at least one winding composed of electrically conductive material; applying plural turns of an insulating layer composed of a number of windings of insulating fiber material, wherein the turns of electrically conductive material are applied independently of the turns of the insulating fiber material; and applying after a predetermined number of the turns of the electrically conductive material have been applied, a smaller number of turns of the electrically insulating material to the turns of electrically conductive material, over a same distance, such that a remaining number of turns of the electrically insulating material up to the number of turns of electrically conductive material are applied as edge insulation for the winding block.

A coil for a transformer is disclosed, comprising: a winding of insulating material applied to an outside of a coil former; an inner winding section of electrically conductive material wound on the winding of the insulating material with a specific number of turns; and a layer of electrically insulating material applied on the inner winding section, wherein a number of turns of the electrically insulating material is less than a number of turns of the inner winding section such that a remaining portion of the electrically insulated material corresponds to a remaining number of turns of the inner winding section, edge sections of the inner winding section being insulated with the remaining portion of the electrically insulating material having a length which corresponds to the remaining number of turns of the inner winding section.

BRIEF DESCRIPTION OF THE DRAWING

Exemplary embodiments of the disclosure and further refinements and advantages will be explained and described in more detail with reference to the drawing, wherein:

The sole FIGURE illustrates a schematic longitudinal section view through an exemplary coil of a transformer.

DETAILED DESCRIPTION

A method is disclosed for production of a winding block for a coil of a transformer, in which there is no need to retrospectively introduce edge insulation.

According to exemplary embodiments of the disclosure, the turns of electrically conductive material are applied independently of the turns of the fiber rovings, by applying a smaller number of fiber roving turns while the predetermined number of wire turns (turns composed of electrically conductive material) are being applied. The remaining number of fiber rovings (e.g., corresponding in length to the number of turns of electrically conductive material less the smaller number of fiber roving turns) can be used for edge insulation.

If, for example, a winding composed of electrically conductive material is wound with ninety turns, then an amount of fiber material corresponding to the amount for these ninety turns is applied to a number less than the number of turns of electrically conductive material, for example with a number of approximately seventy turns of insulating material. In the present example, there are therefore twenty turns of insulating material "left over", which can be used for the edge insulation. The edge insulation is therefore produced at the same time as the production of the insulation and wire winding.

A winding block is also disclosed for a coil in which the method disclosed herein can be used.

The winding block for the coil can include a winding 16 of insulating material applied to the outside of the coil former 10, on which winding 16 an inner winding section $\mathbf{14}_1$ of electrically conductive material is wound with a specific number of turns. A layer $\mathbf{14}_1$ of electrically insulating material can be applied to the inner section $\mathbf{14}_1$, wherein the number of turns of electrically insulating material is less than the number of turns of the inner winding section $\mathbf{14}_1$ such that edge sections are also wound with the turns the remaining number of turns of the electrically insulating material up to the number of turns of electrically conductive material.

In an exemplary embodiment, the axial width of the turns composed of electrically conductive material can be less than the axial width of the turns composed of electrically insulating material.

Referring to the exemplary embodiment illustrated in the FIGURE, a coil of the transformer has a tubular coil former 10 to whose ends coil flanges 11, 12 are fitted. A winding 14 composed of electrically conductive material as well as insulating windings 15 composed of fiber roving material are located in the space 13 between the two coil flanges 11 and 12 and the coil former 10. For this purpose, a number of layers 16 of fiber rovings are wound onto the coil former 10 between the coil flanges 11 and 12, to which fiber rovings wire turns of an inner winding section, also referred to as an inner layer $\mathbf{14}_1$, are then applied for the winding 14. The number of wire turns, for example of the inner layer $\mathbf{14}_1$, is "X", in one exemplary specific case 100 turns, which cover a specific axial length. An insulating layer $\mathbf{15}_1$ composed of fiber rovings is wound onto the length of the layer $\mathbf{14}_1$, with the number of turns of the fiber rovings being "X"-"Y", that is to say there are fewer fiber roving turns over the same length of the wire turns.

For example, in the stated embodiment with one hundred wire turns, eighty turns are wound with fiber rovings. The application of the wire turns of the layer $\mathbf{14}_1$ and the application of the insulating layer $\mathbf{15}_1$ of the fiber roving turns can be carried out independently of one another, thus resulting in the different numbers of turns. Because of the different numbers of turns, the excess number of fiber roving turns can also be wound with fiber rovings in the area $D_1$ and $D_2$ between the ends of the layer $\mathbf{14}_1$ and the coil flanges 11, 12.

The winding 14 can have, for example, two further wire turn sections $\mathbf{14}_2$ and $\mathbf{14}_3$, which are located radially outside the so-called inner layer $\mathbf{14}_1$ and radially outside the insulating layer $\mathbf{15}_1$ of the fiber rovings, and end at a distance D3 from one another. Because there are fewer fiber roving turns than wire turns, the area D3 can then also be wound, in addition to the areas $D_1$ and $D_2$, in the same process, without any problems. In this case, the axial length of each turn is less than the axial length of the relevant fiber roving turn, thus allowing the areas $D_1$ and $D_2$ to be covered, as well as the area $D_3$.

Fiber rovings can be likewise wound onto the layers $\mathbf{14}_2$ and $\mathbf{14}_3$, or winding sections $\mathbf{14}_2$ and $\mathbf{14}_3$, once again with the number of turns of the fiber rovings being less than the number of turns of the winding sections $\mathbf{14}_2$, $\mathbf{14}_3$, thus allowing the area D1 or D2 also to be wound with insulation material in one process. In the same way, further winding sections are provided outside the winding sections $\mathbf{14}_2$, $\mathbf{14}_3$ (without reference numbers), in which the winding with fiber rovings is carried out in the same way as in the case of the inner winding sections $\mathbf{14}_1$, $\mathbf{14}_2$ and $\mathbf{14}_3$.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for production of a winding block for a coil of a transformer, comprising:

applying plural turns of at least one winding composed of electrically conductive material to form a first conductive layer;

applying plural turns of an insulating layer composed of a number of windings of insulating fiber material, wherein the turns of electrically conductive material are applied independently of the turns of the insulating fiber material, wherein a number of turns of the electrically conductive material and the insulating fiber material are equal, and wherein the turns of the electrically conductive material and the insulating fiber material are applied synchronously and with a different axial feed rate; and applying, after a predetermined number of the turns of the electrically conductive material have been applied, a smaller number of turns of the electrically insulating material to the turns of the electrically conductive material, over a same distance, to form a first insulating layer, such that a remaining number of turns of the electrically insulating material up to the number of turns of the electrically conductive material is applied as edge insulation with turns of the insulating fiber material for the winding block, applying, additional electrically conductive material on the insulating layer to form separated winding sections on either side of an axis of the coil, and applying, after a predetermined number of the turns of the additional electrically conductive material have been applied, a smaller number of turns of additional electrically insulating material to the turns of the additional electrically conductive material, over a same distance, to form second insulating layers on each separated winding section, such that a remaining number of turns of the additional electrically insulating material UP to the number of turns of the additional electrically conductive material is applied in a space between the separated winding sections.

2. The method of claim 1, wherein the electrically conductive material is one of a wire and a ribbon material.

3. A coil for a transformer comprising:

a winding of insulating material applied to an outside of a coil former;

an inner winding section of electrically conductive material wound on the winding of the insulating material with a specific number of turns, wherein the specific number of turns of the electrically conductive material and a number of turns of the insulating material are equal; and a layer of electrically insulating material applied on the inner winding section, wherein the number of turns of the electrically insulating material is less than a number of turns of the inner winding section such that a remaining portion of the electrically insulated material corresponds to a remaining number of turns of the inner winding section, edge sections of the inner winding section being insulated with the remaining portion of the electrically insulating material having a length which corresponds to the remaining number of turns of the inner winding section, plural separated winding sections of additional electrically conductive material wound on either side of an axis of the coil and on the electrically insulating material applied to the inner winding section; and plural layers of additional insulating material applied on each separated winding section, wherein the number of turns of the electrically insulating material is less than a number of turns of each separated winding section such that a remaining portion of the additional electrically insulated material corresponds to a remaining number of turns of the separated winding sections, a space between the separated winding sections being insulated with the remaining portion of the additional electrically insulating material having a length which corresponds to the remaining number of turns of the separated winding sections.

4. The coil as claimed in claim 3, wherein an axial width of the turns composed of electrically conductive material is less than an axial width of the turns composed of electrically insulating material.

* * * * *